US005383427A

United States Patent [19]

Tuggle et al.

[11] Patent Number: 5,383,427

[45] Date of Patent: Jan. 24, 1995

[54] TWO-CYCLE, AIR-COOLED UNIFLOW GASOLINE ENGINE FOR POWERING A PORTABLE TOOL

[75] Inventors: Lloyd H. Tuggle; Imack L. Collins; Jeffrey G. Sadler, all of Shreveport, La.

[73] Assignee: WCI Outdoor Products, Inc., Cleveland, Ohio

[21] Appl. No.: 94,604

[22] Filed: Jul. 19, 1993

[51] Int. Cl.[6] ..... F02B 75/06

[52] U.S. Cl. ..... 123/51 BA; 123/53.2; 123/195 R

[58] Field of Search ..... 123/51 R, 53 BA, 53 AA, 123/53 C, 52 A, 51 B, 51 BA, 195 R, 55 VF, 55 VS, 55 VE, 55 R

[56] References Cited

U.S. PATENT DOCUMENTS

| | | | |
|---|---|---|---|
| Re. 15,984 | 1/1925 | Knudsen . | |
| 1,149,142 | 8/1895 | Hornor . | |
| 1,246,121 | 11/1917 | Lemp . | |
| 1,353,481 | 9/1920 | Knudsen | 123/53 BA |
| 1,533,503 | 4/1925 | Knudsen . | |
| 1,681,910 | 8/1928 | Slaght . | |
| 1,736,287 | 11/1929 | Knudsen . | |
| 1,777,478 | 10/1930 | Schaeffers . | |
| 2,048,243 | 7/1936 | Zoller . | |
| 2,063,817 | 12/1936 | Mallory . | |
| 2,117,700 | 5/1938 | Burkhardt | 123/53 |
| 2,133,510 | 10/1938 | Hallett . | |
| 2,168,096 | 8/1939 | Ehrlich . | |
| 2,196,252 | 4/1940 | Daub . | |
| 2,206,272 | 7/1940 | Toth . | |
| 2,289,124 | 7/1942 | Karey . | |
| 2,295,120 | 9/1942 | Maw . | |
| 2,342,900 | 2/1944 | Sandell | 123/53 |
| 2,443,502 | 6/1948 | Guerasimoff . | |
| 2,536,960 | 1/1951 | Sherwood . | |
| 2,628,603 | 2/1953 | Ulrich . | |
| 2,706,970 | 4/1955 | Rinne . | |
| 2,976,861 | 3/1961 | Udale . | |
| 3,537,437 | 11/1970 | Paul et al. | 123/192 |
| 3,570,459 | 3/1971 | Combs | 123/52 |
| 3,766,894 | 10/1973 | Mize . | |
| 3,934,562 | 1/1976 | Isaka | 123/53 BA |
| 4,079,705 | 3/1978 | Buchner . | |
| 4,296,714 | 10/1981 | Buchner . | |
| 4,516,540 | 5/1985 | Nerstrom | 123/65 P |
| 5,213,074 | 5/1993 | Imagawa et al. | 123/196 M |
| 5,243,937 | 9/1993 | Imagawa | 123/195 R |

FOREIGN PATENT DOCUMENTS

| | | |
|---|---|---|
| 594481 | 9/1925 | France . |
| 515492 | 1/1931 | Germany . |
| 518700 | 2/1931 | Germany . |
| 734000 | 4/1943 | Germany . |
| 2347809 | 4/1975 | Germany . |
| 2513380 | 10/1976 | Germany . |
| 252836 | 6/1926 | United Kingdom . |
| 525823 | 9/1940 | United Kingdom . |
| 633280 | 12/1949 | United Kingdom . |
| 730554 | 9/1950 | United Kingdom . |

*Primary Examiner*—E. Rollins Cross
*Assistant Examiner*—M. Macy
*Attorney, Agent, or Firm*—Pearne, Gordon, McCoy & Granger

[57] ABSTRACT

A flexible line trimmer is powered by a two-stroke internal combustion engine. The engine is scavenged in a uniflow fashion and has a scavenging cylinder and an exhaust cylinder connected by a common combustion chamber. Each cylinder has a piston turning one of two cantilevered crankshafts that are geared through adjacent counterweights having integrally formed teeth. The crankshafts extend in opposite directions for self-balancing. One crankshaft is coupled to a flywheel fan and other coupled to a starter. A fuel and air mixture is transferred to a common crankcase for the crankshafts through an intake port located on the exhaust cylinder. The piston of the scavenge cylinder is retarded with respect to the exhaust cylinder. An exhaust window opens prior to a scavenge window. The scavenge window closes after the exhaust window. The exhaust window is shortened to improve crankcase compression. The cylinders are joined in a siamese fashion, fabricated from a single piece, and skewed toward each other. A carburetor and muffler are mounted on substantially opposite sides of the exhaust cylinder.

31 Claims, 7 Drawing Sheets

122
118
116
112
114
119
113
117A
117B
120
105
102
100
110
124
110A
104
108
106

116
118
118
112
114
111
109
121
113
117B
119
117A
102
105

TWO-CYCLE, AIR-COOLED UNIFLOW GASOLINE ENGINE FOR POWERING A PORTABLE TOOL

FIELD OF THE INVENTION

The invention pertains generally to small-displacement internal combustion engines for powering portable tools and equipment, such as forestry, lawn and garden equipment.

BACKGROUND OF THE INVENTION

Small internal combustion engines provide convenience and power to those who use hand-held or portable power equipment, particularly lawn and garden equipment, such as chain saws, lawn mowers, flexible line trimmers, leaf blowers and vacuums, and lawn edgers. Most portable equipment is powered by two-stroke internal combustion engines that are normally aspirated, crankcase scavenged, and spark-ignited. Indeed, this type of two-stroke engine is very well suited to power forestry, lawn and garden equipment. It delivers more power for its weight than a four-stroke engine. Thus, the portable equipment can be made smaller and lighter. It is also a very simple design and, thus, is less expensive to manufacture and maintain and more reliable.

On the other hand, two-stroke engines generally burn fuel less efficiently and emit more pollutants than four-stroke engines. This is in part due to the nature of two-stroke engines, in which fresh fuel and air charge is taken into a cylinder on the same stroke as exhaust is discharged. Scavenging is the process of eliminating, after combustion, gases and filling a cylinder with a fresh charge during the same stroke, usually by displacing the gases with a flow of fresh charge. Scavenging is less than perfect in practice. Fresh charge often mixes with the burned gas, resulting in a mixture of fresh and burned gases that is combustible. Combustion of the mixture is less efficient, reducing power output and creating more pollutant gases. Some of the fresh charge is not trapped in the cylinder and exits with gases to an exhaust system. The lost charge, referred to as scavenge loss, reduces fuel efficiency and increases hydrocarbon emissions.

Two-stroke engines that power portable tools have not been subject to emission control standards applicable to motor vehicles. However, the State of California has passed legislation that will impose rather stringent restrictions on pollutant emission from internal combustion engines in all classes of application, including portable equipment. The United States Environmental Protection Agency has proposed exhaust emission regulations that would apply to portable equipment.

Various methods have been proposed to help to improve the performance of two-stroke engines and to reduce pollutant emissions in two-stroke engines. Many of these methods are explained by Franz J. Laimbock in "The Potential of Small Loop-Scavenged Spark-Ignition Single Cylinder Two-Stroke Engines." These improvement efforts focus on scavenging and trapping efficiency, fuel injection, "lean" air/fuel mixtures, treatment of exhaust with catalysts, and intake and exhaust systems. However, it is not clear which methods will result in sufficient reduction in pollutant emissions to meet legal limits and prove feasible for portable power tools.

Several methods have been proposed to improve scavenging and trapping efficiency. In "loop" scavenging, a scavenging stream of air and fuel enters the cylinder in a direction opposite the exhaust window in the cylinder and flows in a loop. The loop tends to displace exhaust gas in a systematic manner, improving scavenging. The longer the distance travelled by the loop the more effective the trapping. In a "cross-scavenging" design, the scavenge and exhaust ports are on opposite sides of the cylinder. The piston head includes a ramp that deflects the fresh charge upward and away from the exhaust port.

In a "uniflow" engine, scavenging gases flow only in one direction in the cylinder. The scavenge port and the exhaust port are placed opposite each other, generally in the direction of the cylinder axis. Scavenging losses are reduced by the long distance between the scavenge port and the exhaust port. Uniflow engines are understandably well suited to long-stroke engines, such as large-capacity, supercharged, marine diesel engines. In these engines, scavenge losses are air only, as fuel is injected after the exhaust port is closed. In these long-stroke engines, the exhaust port is usually located at the end of the cylinder opposite the scavenge port and controlled with a cam-operated popper valve.

Alternatively, a uniflow engine, may be constructed by bending the cylinder into a "U" shape, in effect creating two cylinders connected by a common combustion chamber. On one cylinder is a scavenge port, controlled by the timing edge of a piston; on the other cylinder is an exhaust port controlled by the timing edge of a second piston. The scavenge piston and the exhaust piston are connected by a common combustion chamber. Each piston moves in opposition with respect to the other.

However, uniflow engines have the disadvantage of being more complicated than conventionally scavenged or loop scavenged engines used in portable power equipment, and thus they are less desirable. A remotely located exhaust valve increases the complexity, size and cost of the engine and raises a number of technical problems such as design of a mechanism to operate the exhaust valve and lubrication of that mechanism, especially when the position of the engine frequently changes during use and storage. Similarly, multiple pistons also tend to increase the size and complexity of the engine.

An alternate approach to improve exhaust emissions of small-displacement internal combustion engines that power portable equipment is to dispense with the two-stroke engine and go with a four stroke engine. A four-stroke engine has significantly less power than a comparably sized two-stroke engine, is more complicated mechanically due the necessity of valves, and is much more difficult to lubricate, especially when it is being held in different positions during use and storage. Nevertheless, as stated, recently issued U.S. Pat. No. 5,213,074, issued to Juragawa et at. and assigned to Ryobi Limited, a four-stroke engine is superior to a two-stroke in that it has relatively clean exhaust, is less noisy and has better fuel economy. Juragawa thus proposes a four-stroke engine with an improved lubrication system to power a portable tool.

SUMMARY OF THE INVENTION

The invention is directed generally to an improved internal combustion engine for powering portable tools, such as those used in forestry, lawns and garden applications. The invention has as one of its primary objectives improving exhaust emissions of two-stroke engines, but also has as an objective adapting engines to have characteristics more advantageous for powering portable work devices. The preferred embodiment of the engine has several inventive aspects, three in particular. First is uniflow scavenging on a multi-piston, two-stroke engine adapted to power portable tools. Exhaust emissions, particularly hydrocarbon and particulate emissions, and fuel economy are improved, while the desirable traits of simplicity, cost, power, reliability and weight usually associated with conventional two-stroke engines are substantially preserved. Second is a double, oppositely extending cantilevered crankshaft configuration that allows for a relatively compact, lightweight, multi-piston engine package (though not limited to a uniflow type) that allows a desirable placement of engine accessories and has good antivibration characteristics. Third is a uniflow engine with double, oppositely extending cantilevered crankshafts.

The following summary is of the preferred embodiment and is intended only to briefly point out various inventive aspects found in the preferred embodiment and their advantages. It should not, in any way, be construed as limiting the scope of the invention as claimed.

In the preferred embodiment, a uniflow scavenged engine includes two cylinders, each with a piston, connected by a common combustion chamber. One cylinder acts as a scavenging cylinder and the other the exhaust cylinder. The timing of the scavenge cylinder piston is retarded with respect to the exhaust cylinder piston. The scavenge port opens after the exhaust port. However, unlike conventional, symmetrically timed two-stroke engines, the scavenge port closes after the exhaust port closes, increasing the duration of the transfer of charge and thus increasing the charge delivery ratio, resulting in greater power. With the increase in the duration of the scavenge port openings, the duration of the exhaust port opening may be decreased without a loss in power. The short exhaust port duration increases trapping efficiency, reducing hydrocarbon emissions, and expands the effective length of the expansion stroke of the pistons, allowing extraction of more work from the combustion gases per cycle.

Locating a crankcase intake port for the fuel/air charge on the exhaust cylinder allows the exhaust port and the intake port to be symmetrically timed. Retarding the scavenge port opening increases crankcase compression of the fuel/air charge. Greater crankcase compression increases the charge delivery ratio and, consequently, power. Furthermore, locating the intake port on the exhaust cylinder frees space for optimal placement of a plurality of scavenging port transfer channels in the scavenging cylinder to provide for improved scavenging. The comparatively cool charge helps to cool the exhaust cylinder. The exhaust cylinder can sometimes run very hot, leading to engine failure, especially when hot and dirty conditions in which portable equipment is often used interferes with air cooling of the engine.

The double, oppositely extending cantilevered crankshafts are mutually coupled for power transmission. Each is driven by a separate piston, though not necessarily in a uniflow scavenged engine. Cantilevered crankshafts are less expensive to manufacture and to assemble than, for instance, a conventional balanced crankshaft. Engine vibration is reduced, as compared to a single cantilevered crankshaft or two cantilevered crankshafts extending in the same direction, since rocking forces of one crankshaft tend to cancel those of the other. Coupling the end of one crankshaft to a flywheel fan and the end of the other coupled to a starter results in a configuration that is comparatively easy to assemble and allows for placement of a starter for easy access and of a fan and blower scroll for optimized cooling. By fabricating the cylinders for each piston in "siamesed" fashion, in single block with no open space between the cylinders, the tops of the cylinders; are skewed or canted toward each other to reduce width of the engine at the top of the cylinders. This permits placement of engine accessories such as the muffler, carburetor, starter and cooling fan/flywheel to be optimized while maintaining a relatively compact engine package. In a uniflow engine, skewing reduces the volume of the common combustion chamber, improving compression for greater power. It also simplifies manufacture. Coupling the crankshafts is accomplished by integrally forming the counterweight with a gear. This gearing results in a simple and compact coupling of the pistons in each cylinder. The cantilevered and the centrifugal forces associated with the rotating counterweights are balanced by substantially in-phase counter-rotation. Crankshafts become self-balancing, as the inertial, rotational and rocking forces of each crankshaft balances those of the other, reducing vibration. Also, timing offsets between each of the cylinders are easily accomplished during manufacture. Aligning each cylinder bore's centerline so that it intersects the axis of rotation of its respective crankshaft eliminates the need to modify the cylinders for rod clearance and results in less piston friction, and thus more reliability.

A uniflow engine having the exhaust and intake ports located on the same cylinder and oppositely extending, cantilevered crankshafts not only has advantages previously noted in connection with each, but also additional advantages. By monitoring each crankshaft in a common crankcase or in two chambers connected by a passage, induction of charge on the exhaust cylinder creates a cross-flow of charge through the crankcase that improves lubrication and cooling of the crankshaft coupling. Skewing and siamesing the two cylinders allows the engine package to remain relatively compact when the carburetor and muffler are attached to the same cylinder. Also, it reduces the volume of the common combustion chamber to be reduced while increasing the length of the cylinder bores and allows the chamber to be shaped more spherically. The greater thrust surface area and placement of the charge intake port on the exhaust cylinder each make available more wall area in the scavenging cylinder for best locating transfer channels to promote the scavenging. The transfer channels are located and oriented to produce a rising swirl of charge that is aligned with the centerline of the common combustion chamber to promote efficient cross-over to the exhaust cylinder.

The preferred embodiment of the claimed invention is subsequently described in connection with the appended drawings. Other aspects and advantages will be described or will otherwise be apparent from this description.

DETAILED DESCRIPTION OF THE PREFERRED EMBODIMENTS

In the following description, like characters reference like parts.

Figures 1, 2:
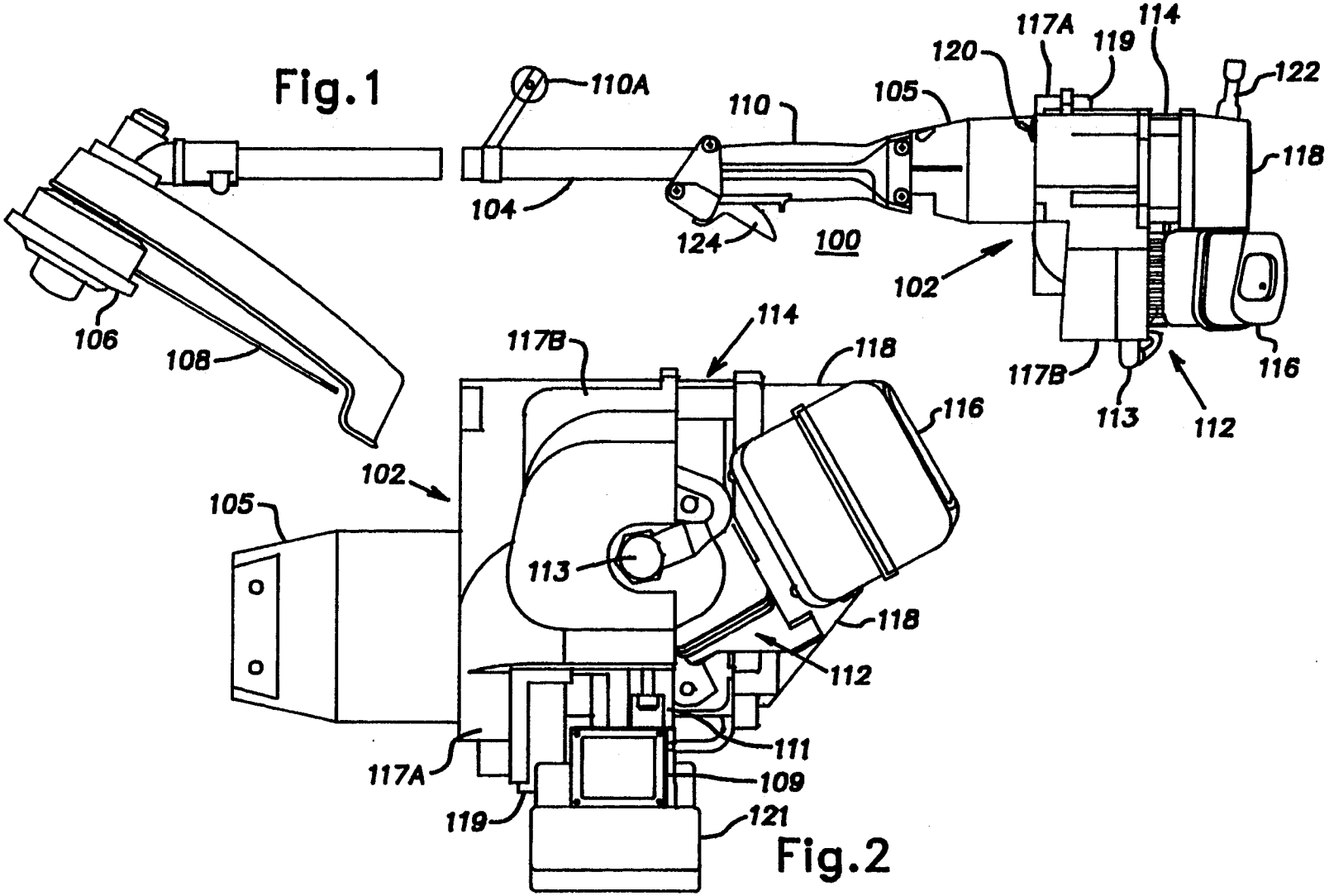
FIG. 1 is side view of a flexible line trimmer having a uniflow engine embodying the present invention.
FIG. 2 is a bottom elevational view of the uniflow engine depicted in FIG. 1.
Figure 3A:
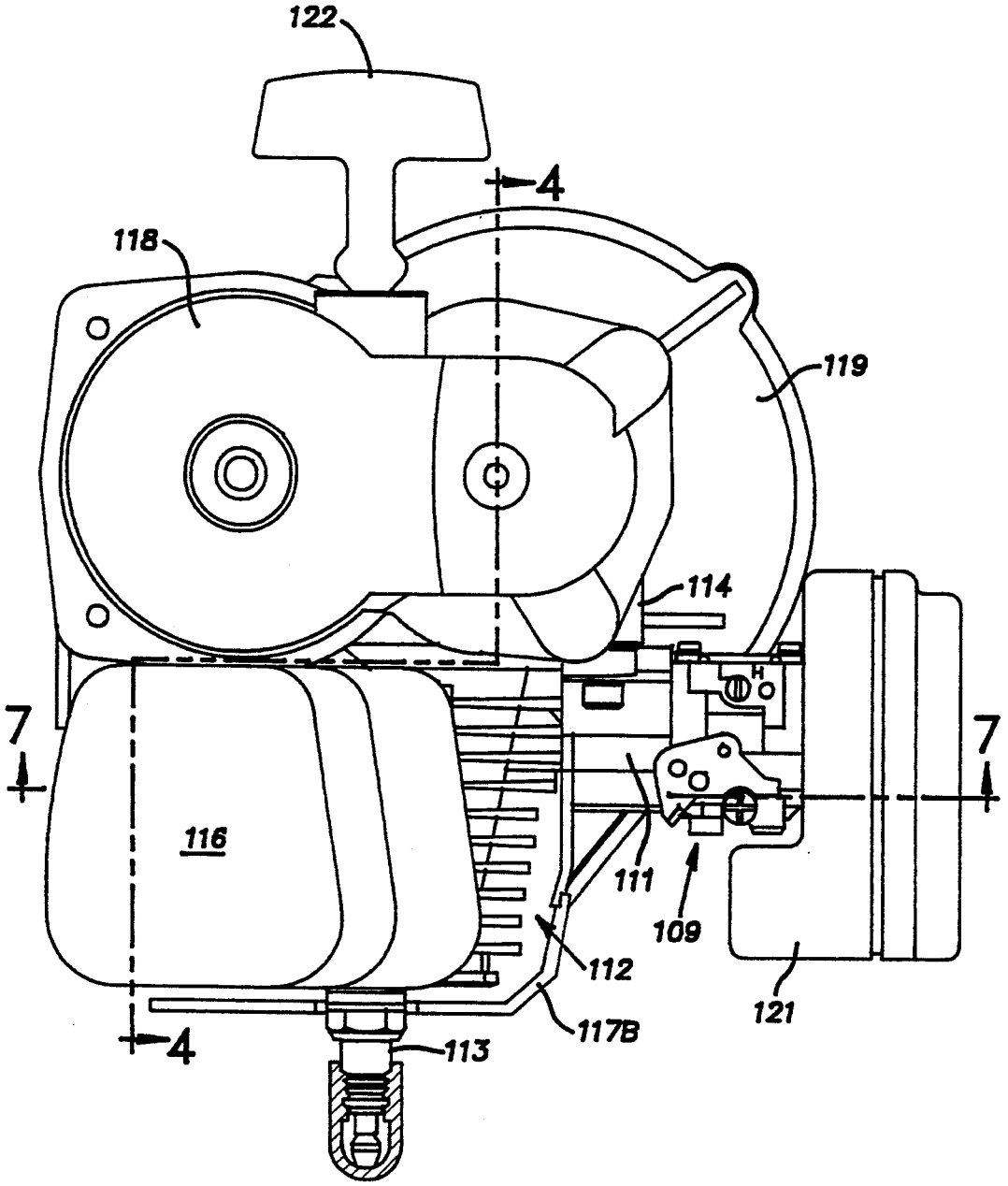
FIG. 3A is a rear elevational view of the engine of FIG. 1.

Referring to FIGS. 1, 2 and 3A, the invention is described in connection with flexible line trimmer 100. The flexible line trimmer is intended to be representative of portable work producing apparatus, particularly those used in forestry, lawn and garden applications, such as chain saws, leaf blowers, trimmers of all varieties, snow blowers, lawn edgers, hedge trimmers and the like.

In a conventional manner, an internal combustion engine 102 acts as a power source to rotate a drive shaft (not shown) disposed within rigid tube 104. Clamp 105 is tightened around tube 104 to hold the engine to the end of the tube. Behind the clamp, them is a coupling for connecting the drive shaft to a centrifugally operated clutch that is, in turn, coupled to the engine's crankshaft. At its lower end, the drive shaft is coupled to line head 106 or, alternately, other cutting or work producing device to transmit the rotational power from the engine to the work producing device. The rotational power turns the line head about an axis, causing a length of flexible line 108 that extends in a direction perpendicular to the axis of rotation of the head to be flailed. The angle between the axis of the head and the tube 104 permits a person to comfortably grip with each hand a rear handle 110 and a forward auxiliary handle 110A and maneuver the trimmer to cut vegetation with the flexible line. Preferably, the line trimmer is balanced about a point in proximity of the handles.

The internal combustion engine 102 includes an integrally formed cylinder block 112, spark plug 113 and a crankcase 114. The cylinder block includes a plurality of cooling fins disposed around the circumference of the cylinder block, in a conventional manner, for cooling the engine. Carburetor 109, attached to the cylinder block with mount 111, mixes air drawn through the air filter 121 with a fuel and oil mixture and provides the resulting charge to intake port defined through the wall of the cylinder block. Muffler 116 mates with an exhaust port on the cylinder block 112 to receive exhaust gases and then to expel the gases to a lower pressure, generally rearwardly and away from a person holding the trimmer. In a normal operating position of the trimmer, the cylinder block hangs down under the crankcase, to provide better balance and control over the trimmer.

In front of the crankcase and cylinder block of the engine is an integrally formed fan housing and engine shroud 117. Mounted for rotation within a volute formed by fan housing section 117A and a matching, volute-shaped extension section 119 of crankcase 114 is a fan (not shown) for drawing in cooling air and blowing it across cooling fins of cylinder block 112. Section 117B of the blower housing helps to direct the cooling air rearwardly and away from the operator, over the cooling fins and toward the muffler to take away heat generated by combustion from the cooling fins and the muffler.

As will be discussed in more detail, the cylinder block 112 includes two "siamesed" cylinders having a common combustion chamber to form a uniflow style engine. Preferably, each cylinder has a stroke to bore ratio of at least 1.33. The cylinder block is formed as a single, integral piece by casting the part with two cores to form the cylinder bores and portions of the combustion chamber. After removal of the cores during the casting process, the formation of the combustion chamber is completed by drilling and tapping of the threads for the spark plug. The drilling removes material from between the two combustion chamber portions, forming a continuous path for uniflow of gases.

The bore centerline of each cylinder is offset with respect to the other, both in the direction of and in the direction perpendicular to the axis of drive shaft and then canter toward each other. This configuration tends to maximize the outside area of the cylinders exposed to cooling air blown from the flywheel fan, and thus provide for more efficient cooling of the engine. It also minimizes the volume of the combustion chamber to improve the compression ratio.

At the rearward end of the crankcase 114 is starter housing 118. In a conventional manner, an operator, after turning on ignition switch 120, pulls upwardly on starter handle 122 to start the engine while supporting the weight of the trimmer in a balanced condition with the other hand around tube 104. Pulling the handle rotates a starter pulley within starter housing 118 and couples it to a crankshaft of the engine. Lever 124 is coupled to the throttle of carburetor 109 to control the speed of the engine.

Figure 3B:
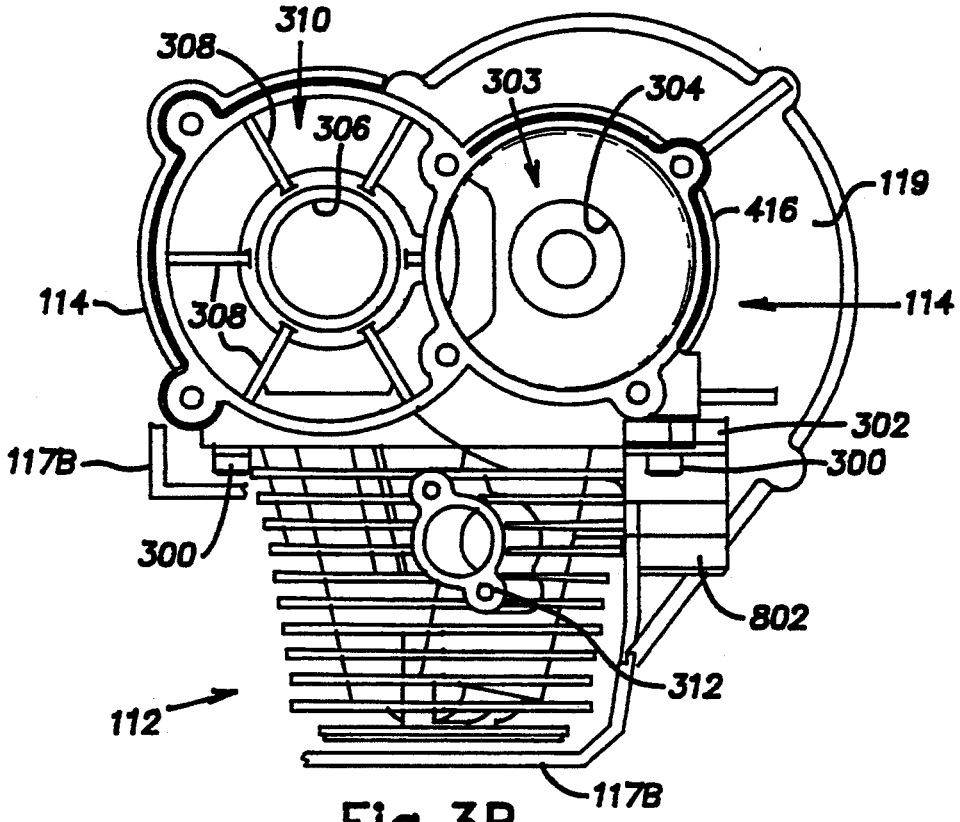
FIG. 3B is a rear elevational view of the crankcase, a cylinder block and blower housing of the engine of FIG. 1.

Please note that a fuel tank is not shown but is mounted to the top of the crankcase. Referring now to FIG. 3B, the illustration is a rear elevational view of a disassembled engine of FIG. 2, with just the crankcase 114, cylinder block 112 and blower housing 117B remaining. The cylinder block 112 is connected to the crankcase 114 by bolts 300 extending through holes in flange 302 of the cylinder block.

The crankcase is configured to mount two cantilevered crankshafts (not shown), and thus will be referred to as a common crankcase for the crankshafts. End opening 303 of the crankcase allows insertion of a first crankshaft extending forwardly. The crankshaft is supported for rotation by bearings within a cylindrically shaped bearing mount 304. A second crankshaft (not shown) extends rearwardly and is supported for rotation by bearings mounted within a second cylindrically shaped bearing mount 306. A plurality of ribs 308 extend radially outwardly along an end wall 310 of the crankcase surrounding the opening of the bearing support 306. The ribs structurally strengthen and support the bearing mount 306. Located on to the rear and side of the cylinder block is an exhaust port flange 312, to which a muffler 116 (not shown) is mounted.

Figure 4:
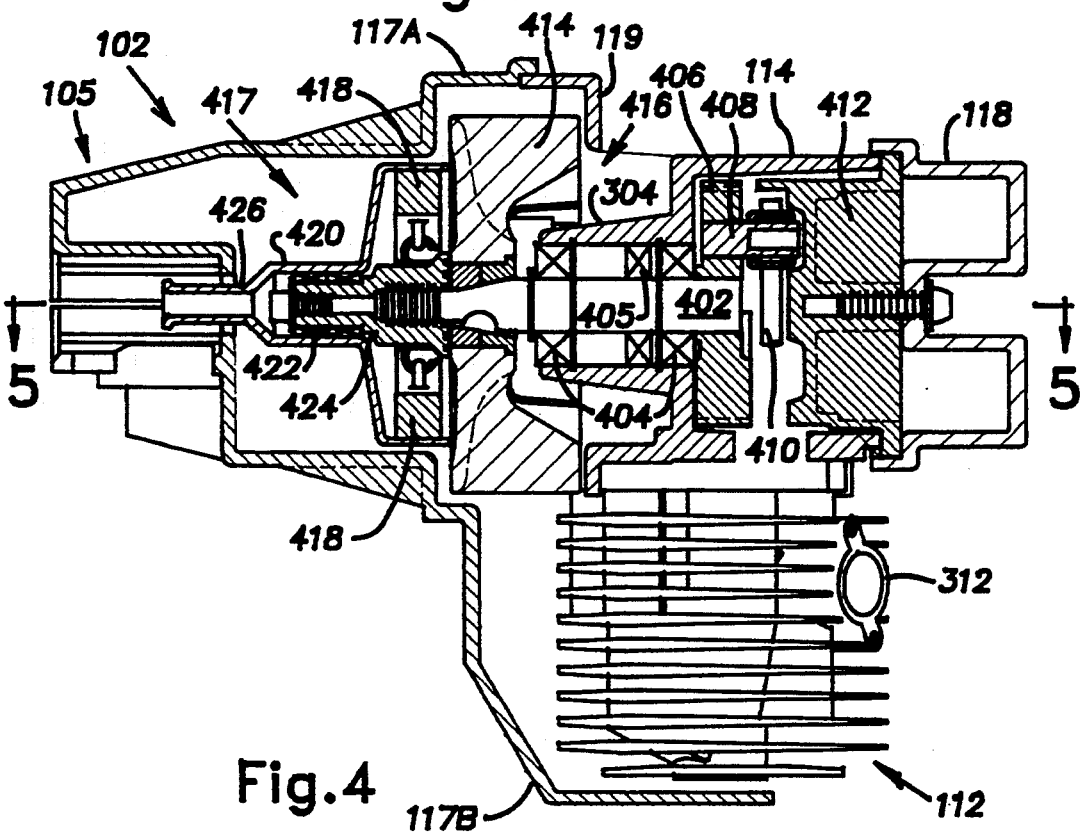
FIG. 4 is a side, elevational view of the engine of FIG. 1 that is partly sectioned along line 4—4 indicated on FIG. 3.

FIG. 4 is a side view, partially cross-sectioned through the crankcase 114 of the uniflow engine shown in FIGS. 1-3A, taken along a section line 4—4 in FIG. 3A. The muffler 116 and its mount are removed to reveal exhaust port 312 defined through the sidewall of the cylinder block 112. FIG. 4 is, in essence, a cross section of the portion of common crankcase 114 in which a first, forward extending cantilevered crankshaft 402 is supported for rotation by a set of bearings 404. The set of bearings are mounted with seal 405 within cylindrically shaped bearing mount 304, that is integrally formed in the crankcase 114. One end of the cantilevered crankshaft 402, referred to as a proximal end for convenience, is attached to a geared counterweight 406. A crank pin 408 is attached to the counterweight, eccentric to the axis of rotation of the crankshaft, and extends in a rearward direction, parallel to the axis of rotation of the crankshaft. One end of a connecting rod 410 is rotationally coupled to crankpin 408 in a conventional manner. The other end of the connecting rod is coupled in a conventional manner to a first piston (not seen) so that reciprocating, translational motion of the piston moves the crankpin eccentrically about the crankshaft, which, in ram, rotates the crankshaft.

At the rear of the engine, opening 302 (see FIG. 3) of the crankcase is closed with plug 412. Starter housing 118 is bolted to the end plate.

A flywheel fan 414 is coupled to rotate with the forward or distal end of the first crankshaft. The flywheel fan is of conventional design and includes a plurality of centrifugal impeller blades. Rotation of the flywheel fan draws in cooling air along its axis of rotation, through openings 416 defined between the crankcase 114 and the extension section 119 of the crankcase. The slots are located generally on a top side of the engine, as far away as possible from the ground and trimmer head to reduce the mount of debris entrained in the air. The flywheel fan blows the air radially outwardly into a volute formed between extension 119 and fan housing section 117A. The volute collects and directs the air toward the cylinder block and engine shroud 117B directs the blown air rearwardly, toward and around the cylinder block 112, in a direction generally parallel to the cooling fins on the cylinder block. The cylinder block has an elongated aspect, which is better seen in other figures, due to its dual siamesed cylinders. To further narrow the profile of the cylinder block presented to the blown air, the cylinders are canted or skewed toward each other. This narrow profile, oriented to point into the predominant flow of the blown air, exposes a maximum surface cooling area of the fins to the blown air and thereby improves cooling efficiency.

Forward of the flywheel fan, a conventional centrifugal clutch assembly 417 is coupled to the end of crankshaft 402. The clutch includes a shoe assembly 418 attached to the flywheel fan 414. The shoes are biased by springs in a retracted position and extend radially outwardly under influence of centrifugal forces generated by rotation of the crankshaft. At some rotational speed of the crankshaft greater than idle speed (typically 1000 R.P.M. greater than idle speed), the shoes extend far enough to engage and rotate drum 420. The drum is supported for rotation by bearings 422 mounted on a crankshaft extension of flywheel retention nut 424. The drum 420 includes a coupling section 426 for coupling to a drive shaft (not seen) disposed within tube 104 (FIG. 1).

Figure 5:
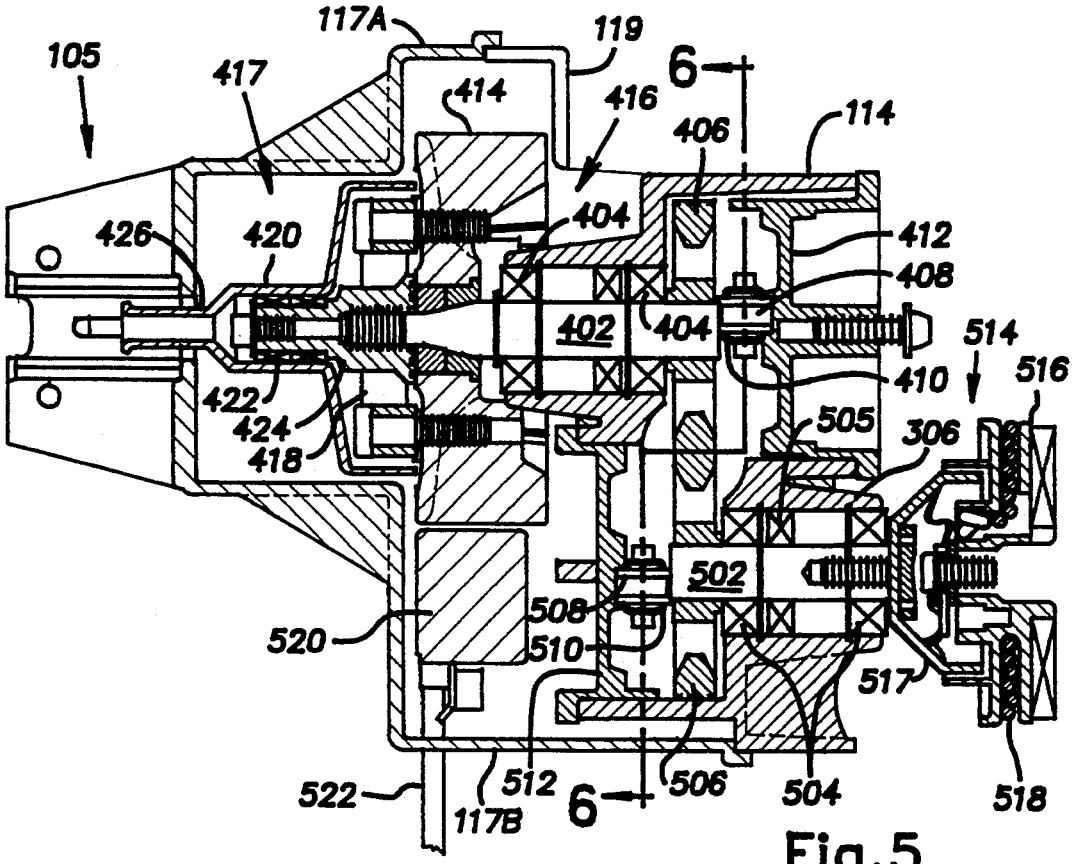
FIG. 5 is a cross-section taken along line 5—5 in FIG. 4.

Referring now to FIG. 5, which is a cross section of FIG. 4 taken along section lines 5—5, a second cantilevered crankshaft 502 extends rearwardly and parallel to the first cantilevered crankshaft 402. Just like crankshaft 402, it is supported in a cantilevered fashion for rotation by bearings 504 mounted within bearing mount 306 with seal 505. It has attached to one end a geared counterweight 506 that is identical to the geared counterweight 406. A connecting rod 510 connects the crankpin 508 to a second piston (not seen) in a conventional manner, as described in connection with crankshaft 402. Geared counterweight 506 engages geared counterweight 406 so that teeth extending outwardly from the circumference of each counterweight mesh. Each crankshaft turns at the same speed, and power from the second piston is transmitted to the first crankshaft 402.

There are several advantages of extending the cantilevered crankshafts in opposite directions. Rocking forces in one cantilevered crankshaft are balanced by those in the other. Inertial and rotational forces associated with one crankshaft are balanced by those of the other due to counter rotation of the crankshafts. Thus, vibration is significantly reduced. Gearing the counterweights saves space, reduces weight and simplifies assembly. The double crankshafts easily accommodate asymmetrical timing, if desired, between the first and the second pistons by retarding the relative position of one of the geared counterweights with respect to the other. The overall geometry of the engine package is made more compact by offsetting the planes in which the crankpins 408 and 508 turn, in the direction of the axis of rotation of the crankshafts. This allows the pistons to be offset along the axes of the crankshafts and then skewed toward each other.

Furthermore, a starter assembly 514 mounted to the free or distal end of the second crankshaft 502, permits locating the starter at the rear of the engine. Assembly of the engine is thus simplified, as a single crankshaft need not accommodate the starter, flywheel fan and clutch. The starter assembly includes a conventional recoiling pulley 516 that is mounted for free rotation on a shaft that is part of starter cover 118 (not shown). Starter gear 517 is directly coupled to the crankshaft for rotation with the crankshaft. A starter cord 518 wraps about the starter pulley. The starter pulley is coupled to the starter gear with a conventional spring-biased pawl or dog mechanism so that rotating starter pulley with the starter cord when the engine is at rest turns the starter gear but the pulley disengages from the starter gear when the engine is running. A spring on the starter pulley recoils the rope onto the pulley.

An end plug 512 is secured over an opening in the front of crankcase 114 through which the second cantilevered crankshaft is installed. A conventional ignition module 520 is mounted in close proximity to the flywheel fan 414. A magnet on the flywheel excites the ignition module to produce an electrical charge that is transmitted through wire 522 to spark plug (not seen) mounted in the combustion chamber common to each of the two cylinders for igniting a fuel/air mixture.

Figure 6:
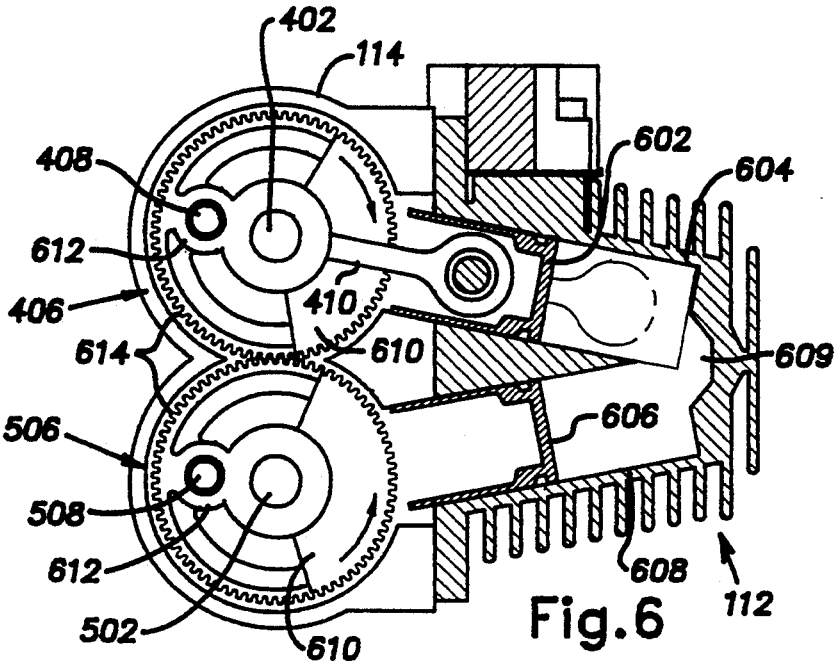
FIG. 6 is a cross-section taken along section lines 6—6 indicated on FIG. 3A.

Referring now to FIG. 6, a connecting rod 410 and crank pin couple the first piston 602 to the first cantilevered crankshaft 502 in the manner previously described. This first piston is mounted within a cylindrical bore of a first cylinder 604. The first cylinder will be referred to as the exhaust cylinder. The centerline of the bore intersects the axis of rotation of crankshaft 502 to provide maximum thrust surface along the inner diameter of the bore. Similarly, a second piston 606 is mounted for reciprocating, translational motion within a bore of cylinder 608. The centerline of the bore of the second cylinder intersects the axis of rotation of the second cantilevered crankshaft 402. The second piston is coupled to crankpin 408 by connecting rod 510 (not shown). The second cylinder will be referred to as a scavenging cylinder.

The scavenging and the exhaust cylinders are connected at their top by a common combustion chamber 609. A spark plug, not shown, is mounted through the ceiling of the common combustion chamber. The cylinders are siamesed, meaning that there is no open space between the cylinders. The cylinder block is fabricated as a single piece. Only the aluminum material from which the cylinder block is fabricated occupies the space between the cylinders. Furthermore, the cylinders are skewed or canted with respect to each other such that, in this section, they appear to overlap. Offsetting of the cylinders with respect to each other in opposite directions along the axis of the respective crankshaft, as seen in FIG. 5, accommodates this skew. Skewing the cylinders helps reduce the width of the top of the cylinder block, and provides, as will be subsequently explained, placement of a muffler and carburetor in positions that do not substantially increase the girth and length of the engine, and improves cooling efficiency as previously explained. Furthermore, the volume of the common combustion chamber is minimized.

Each geared counterweight 406 and 506 is integrally formed and has a counterweight portion 610, a crankpin support portion 612 and an annular shaped portion 614 forming an outer circumference on which gear teeth are formed. The teeth on each counterweight mesh. Both have the same circumference and each turns at the same speed, but in opposite directions.

Figure 7:
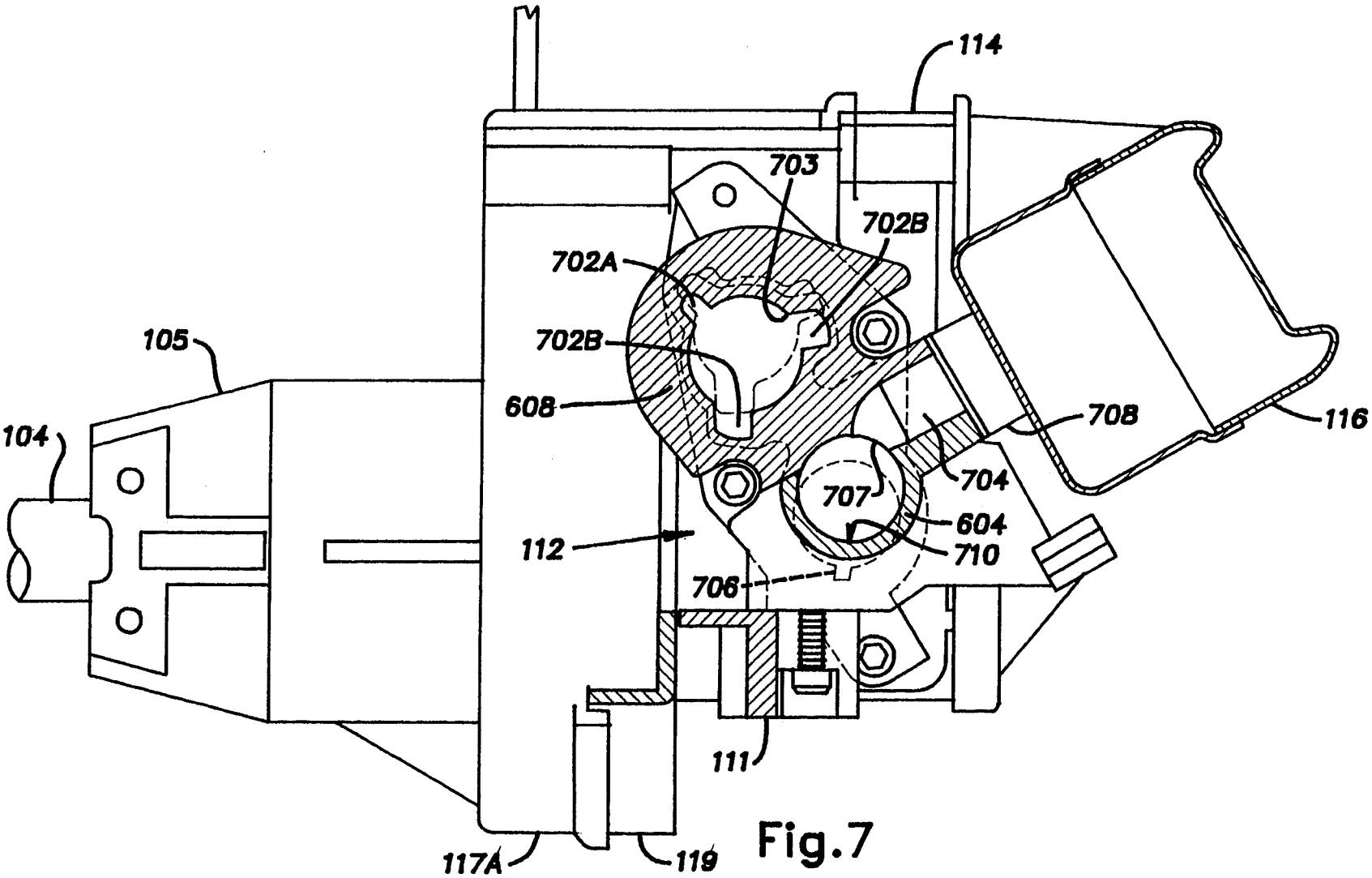
FIG. 7 is a bottom view of the engine shown in FIG. 1, with its muffler removed and sectioned through its cylinder block.

Referring now to FIG. 7, this is a bottom view of the engine, With a section taken through the cylinder block 112, along lines 7—7 in FIG. 3A. The carburetor and the first and second pistons are removed for clarity. The scavenge cylinder 608 has a plurality of scavenge ports formed by a plurality of transfer channels 702A, 702B defined along the inside diameter of the cylinder. The upper edge of the second piston (not shown) exposes a top portion of channel, which is also referred to as a scavenging port, just before the bottom of the piston's stroke so that charge flows from the crankcase into the scavenging cylinder and closes the channel on its upstroke. Phantom lines 703 outline the inner diameter of the cylinder bore. Transfer channels are parallel to the center line of the cylinder bore. To produce a swirl of charge within the scavenge cylinder that improves scavenging, one of the transfer channels, an "auxiliary" channel 702A, is made smaller than the other "primary" transfer channels 702B. The transfer channels are placed so that no auxiliary transfer channel is aligned with the centerline of the common combustion chamber 609 (FIG. 6) and the primary transfer channels are symmetrical about this centerline.

The exhaust port is formed by a window 707 defined in the side wall of the exhaust cylinder 604 and is opened when the top edge of the first piston (not shown) nears the bottom of its stroke. Trapping efficiency is improved by retarding the timing of the piston in the scavenging cylinder with respect to the piston in the exhaust cylinder, so that scavenge port opens and closes after the exhaust port. Muffler 116 is coupled to the exhaust port through a mounting adapter 708 and is located immediately adjacent the cylinder block to conserve space.

Fresh charge is transferred to the crankcase from the carburetor (not shown) through an intake port located on the exhaust cylinder. The intake port is formed by a window on the outside of the cylinder that connects to the top of a channel, a section of which is indicated by phantom line 706, running along the inside wall of the exhaust cylinder. The bottom of the channel is opened by the bottom edge of the skirt of the first piston during its upstroke to allow fresh charge from the carburetor to enter the crankcase. Then, under negative pressure, it remains open during the top portion of the downstroke. However, it closes well prior to the opening of the scavenge ports on the scavenging cylinder 608 in order to trap and begin to pressurize the charge in the crankcase. Continued downward movement of the first and second pistons after opening of the crankcase displaces the charge in the crankcase so that it flows into the scavenging cylinder.

Locating the intake port on the exhaust cylinder has two primary benefits. First, the fresh charge helps to cool the exhaust cylinder, which tends to run hotter than the scavenging cylinder because of the hot combustion gases exiting to the muffler. Second, the charge must travel across the crankcase to scavenge ports. This cross-flow of charge from one side of the common crankcase to the other helps to ensure that the gearing and other moving components in the crankcase are coated by the lubricants in the fuel.

The skewing of the exhaust cylinder 604 toward the opposite crankshaft narrows the width of the top of the cylinder block 112 and allows placement of the carburetor (not shown for clarity) adjacent the intake port but away from the heat of the muffler without significantly increasing the engine's width.

Figure 8:
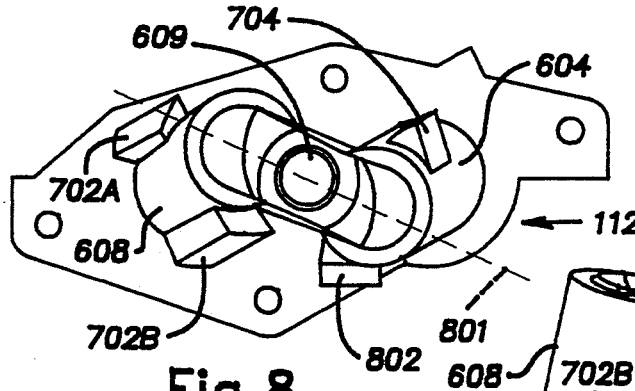
FIG. 8 is a schematic representation of a bottom view of the cylinder block of the engine of FIG. 1 with cooling fins removed.
Figure 9:
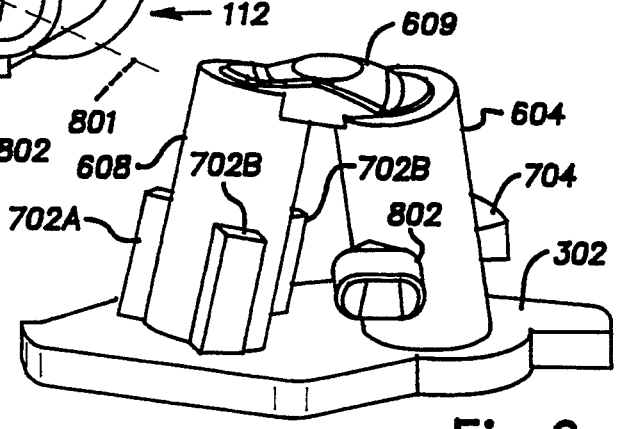
FIG. 9 is side view of the schematic representation of FIG. 8.

FIGS. 8 and 9 are schematic representations that show the cylinder block 112 stripped of its cooling fins and with a significant amount of material removed between the cylinders 604 and 608. The purpose is to clearly show the skewed orientation of the cylinders.

Figure 10A:
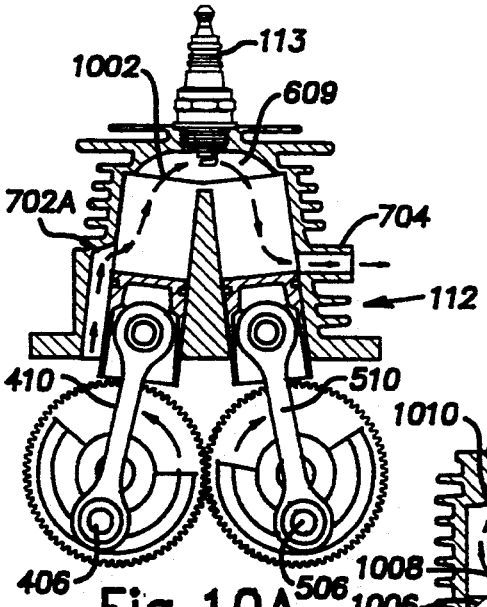
FIG. 10A and 10B schematically represent, in cross-section, the positions of each of the pistons in the engine of FIG. 1.
Figure 10B:
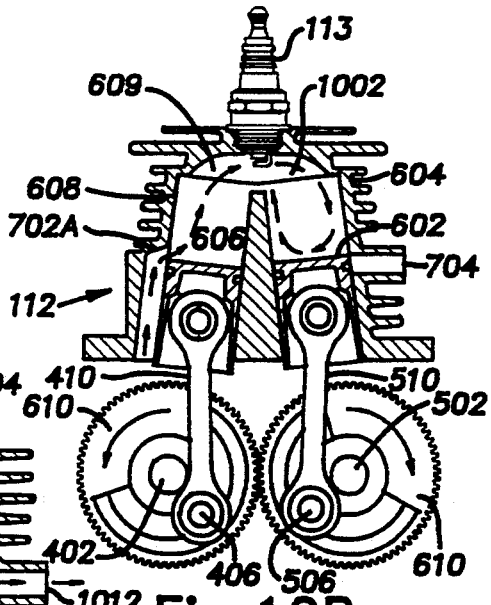

Referring to FIGS. 10A and 10B, these schematic diagrams illustrate the positions of the pistons 602 and 606 in, respectively, the exhaust cylinder 604 and the scavenge cylinder 608 at (FIG. 10A) and after (FIG. 10B) the bottom dead center position of exhaust piston 602. Referring only to FIG. 10A, the exhaust port 704 and the scavenge ports 702A, 702B are open, creating a flow of exhaust through the exhaust port that has been displaced by a flow charge of charge entering the scavenge cylinder from the scavenge ports, travelling through the common combustion chamber 609 and into the exhaust cylinder. The flow of the charge and the displaced exhaust gases is in one direction, as indicated by arrow 1002. The boundary between the exhaust gases and the fresh charge is not indicated. The boundary is not, in practice, sharply defined and some mixing invariably occurs. Charge swirling, as previously described, helps to move the boundary evenly toward the exhaust port opening.

Referring now only to FIG. 10B, close to the time this boundary reaches the exhaust port, the exhaust port doses to trap as much of the fresh charge as possible and to minimize charge loss. The scavenge ports, however, remain open to promote complete and even scavenging of both cylinders, as indicated by arrows 1002 turning in the exhaust cylinder back toward the combustion chamber.

Figure 10C:
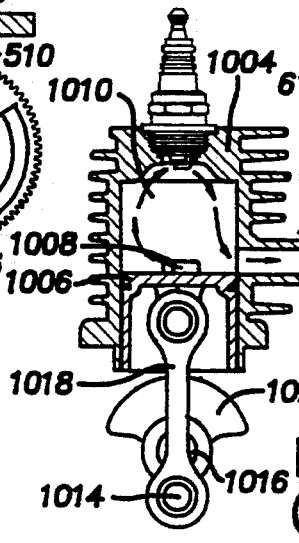
Fig.10C (PRIOR ART)
FIG. 10C is a schematic illustration of a prior art, conventional loop scavenged, two-stroke internal combustive engine.

FIG. 10C is a schematic representation of a conventional, prior art, loop scavenged two stroke internal combustion engine. The engine includes a single cylinder 1004 that is scavenged through a transfer port 1008 located in the middle of piston 1006. The port is oriented so that the charge flows in a loop, as indicated by line 1010, to displace exhaust gases through exhaust port 1012. The piston is coupled to a crankpin 1014 that is eccentrically mounted on cantilevered crankshaft 1016 through connecting rod 1018. Counterweight 1020 helps to balance the internal and rotational forces associated with movement of the piston and crankshaft.

Figure 11A:
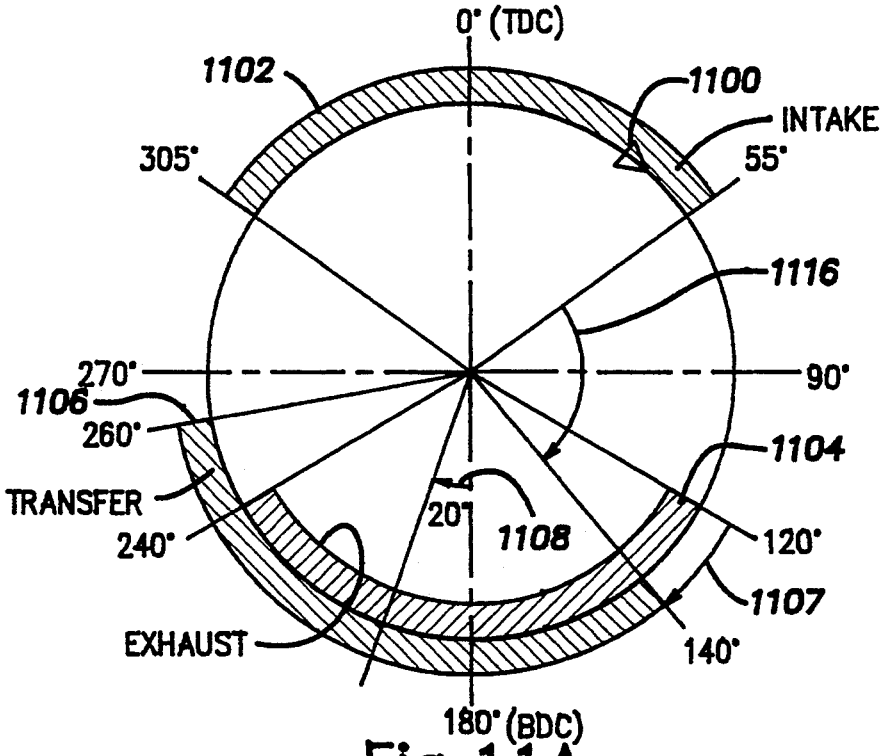
FIG. 11A is a timing diagram of the exhaust intake and scavenge or transfer parts, for the engine of FIG. 1, based on the rotational position of the exhaust cylinder crankshaft.
Figure 11B:
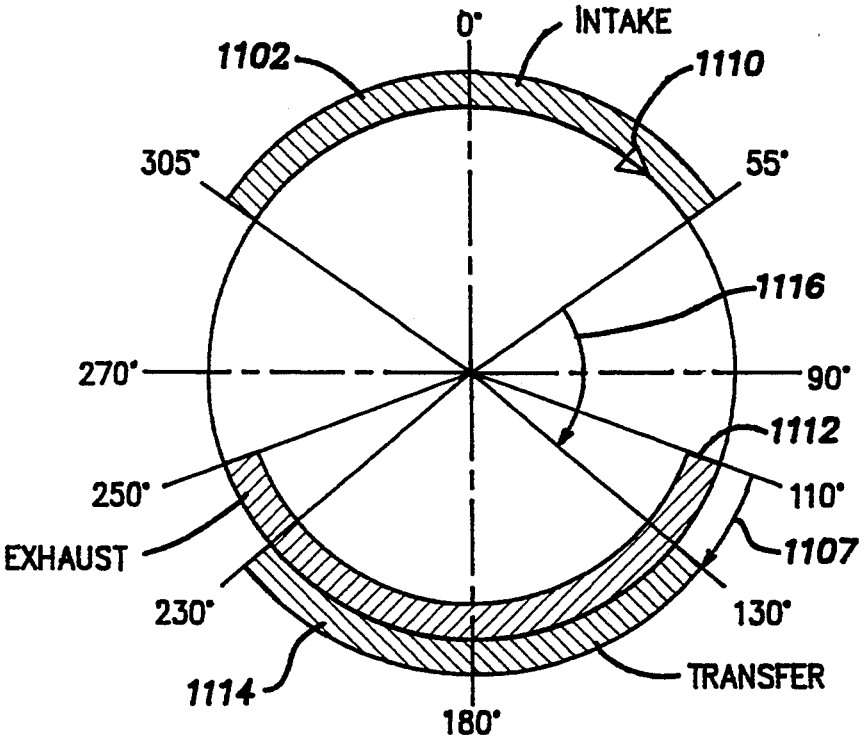
Fig.11B (PRIOR ART)
FIG. 11B is a timing diagram for a prior art, conventional two-stroke, loop scavenged engine.

FIGS. 11A and 11B, both schematic in nature, illustrate the differences in timing of the intake, exhaust and transfer or scavenge ports between an asymmetrically timed, two-cylinder, crankcase scavenged uniflow engine (FIG. 11A), as previously described in connection with FIGS. 1–10B, and a symmetrically timed, conventional two-stroke, single cylinder engine (FIG. 11B) shown in FIG. 10C. In FIG. 11A, circle 1100 is the rotational position of the exhaust cylinder crankshaft. In FIG. 11B, circle 1110 is the rotational position of the single crankshaft. In both, top dead center and bottom dead center are, respectively, 0 degrees and 180 degrees. The conventional engine and the uniflow engine has an intake port window 1102 that is symmetric about top dead center. The center of the intake window 1102 of the uniflow engine is 180° opposite the center of the exhaust window 1104. The duration of both is approximately equal. The exhaust port window 1104 of the uniflow engine and the exhaust window 1112 of the conventional engine are both centered about bottom dead center. However, unlike the conventional engine, the scavenging window 1106 of the uniflow engine of FIG. 11A is retarded by 20 degrees with respect to bottom dead center, as indicated by arrow 1107, and opens after the exhaust port window 1104 and closes after the exhaust port window closes. This accommodates a desirable exhaust blowdown (angle 1107) prior to scavenging, but for a longer scavenging period that continues after the exhaust port closes. The scavenge window 1114 of the conventional engine must close before the exhaust window 1112. Independent control of the exhaust port window 1104 of the uniflow engine allows more choice over the timing of its opening and its duration to improve trapping efficiency than a conventional two-stroke engine. Furthermore, the exhaust port window of the uniflow may be shortened as compared to a conventional engine. This accommodates greater crankcase compression of charge, which is indicated by angle 1116, charge without sacrificing a desirable blowdown angle. More crankcase compression results in better charge delivery ratios.

Numerous modifications, rearrangements and substitutions of the preferred embodiment are or will be apparent to those skilled in the art without departing from the spirit of the invention. The scope of the invention is therefore not limited to this preferred embodiment, but includes all such modifications, rearrangements and substitutions that fall within the scope of the invention as is claimed.

What is claimed is:

1. A portable tool having an engine with improved exhaust emissions, comprising:

a work implement supported on a means for mounting;

handles coupled to a means for manually maneuvering the work implement;

a two-stroke, spark-ignited uniflow engine coupled to the work implement, the engine including;

a first piston mounted for reciprocal, linear movement within a first cylinder, the first cylinder including a plurality of scavenge ports;

a second piston mounted for reciprocal, linear movement within a second cylinder, the second cylinder including an exhaust port;

a common combustion chamber joining the first and second cylinders for establishing a flow of fresh charge and exhaust in the cylinders substantially in one direction from the scavenge port toward the exhaust port; wherein the first and second cylinders and the common combustion chamber form a "U" shape and wherein trapping efficiency of the cylinders is improved;

a common crankcase wherein the first and second pistons are respectively coupled to first and second crankshafts that are coupled to deliver power to the work implement, said first and second crankshafts being coupled for mutual counter-rotation and extending in opposite, but parallel directions;

a muffler mounted to the second cylinder and in fluid communication with the exhaust port for receiving exhaust gases;

a carburetor mounted adjacent the common crankcase for delivering a mixture of fuel and air to the crankcase, the carburetor being generally remote from the muffler; and a fan driven by the engine for blowing cooling air past the first and second cylinders for cooling the engine.

2. The portable tool of claim 1 wherein the first cylinder includes the plurality of scavenge ports for producing a swirl of charge that is aligned with a centerline of the bore of the combustion chamber to promote scavenging.

3. The portable tool of claim 1 wherein the first and the second piston are coupled such that timing of the first piston is retarded with respect to timing of the second piston, resulting in the exhaust port opening before the scavenge port and the scavenge port closing after the exhaust port, thus improving trapping efficiency.

4. The portable tool of claim 1 wherein the first and second crankshafts are supported in a cantilevered fashion and mutually geared.

5. The portable tool of claim 4 wherein the timing of the first and the second crankshafts are asymmetrical, resulting in the scavenge port opening after the exhaust port opens and closing and after the exhaust port closes in a manner thus improving trapping efficiency and minimizing scavenging loss, whereby exhaust emissions are improved.

6. The portable tool of claim 4 wherein the first and the second cantilevered crankshafts extend in opposite directions, and wherein the first crankshaft is coupled to the fan and the second crankshaft is coupled to a starter.

7. The portable tool of claim 4 further including a charge intake port for the crankcase located on the second cylinder having a timing controlled by the second piston; wherein inducted charge flows across the crankcase to a transfer channel for the scavenge ports in the first cylinder, cooling and lubricating the coupling of the first and second crankshafts.

8. The portable tool of claim 4 wherein the first and the second cantilevered crankshafts extend in opposite directions such that cylinders are offset with respect to each other along the direction of the respective crankshafts; and wherein the cylinders are canted toward each other, in planes perpendicular to the respective crankshafts.

9. The portable tool of claim 1 wherein the second cylinder further includes a charge intake port for the crankcase located on the second cylinder having a timing controlled by a skirt of the second piston; and wherein the first and the second pistons are coupled such that timing of the first piston is retarded with respect to timing of the second piston such that the exhaust port opens before the scavenge port and the scavenge port closes after the exhaust port, the retarding resulting in greater crankcase compression that improves charge delivery.

10. An internal combustion engine for coupling to a work producing implement to deliver power and improved exhaust emissions, the internal combustion engine comprising:

first and second pistons mounted respectively in first and second cylinders; and first and second crankshafts supported in a cantilevered fashion and driven, respectively, by the first and second pistons; each cantilevered crankshaft having first and second ends and each having a counterweight and crank pin mounted on its first end for rotating the crankshaft with the respective piston;

wherein the first and the second cantilevered crankshafts are coupled for mutual counter-rotation and extend in opposite, but parallel directions.

11. The engine of claim 10 further comprising:

a starter coupled to the second end of the first crankshaft; and a flywheel and clutch coupled to the second end of the second crankshaft.

12. The engine of claim 10 wherein the counterweights include gear teeth, the counterweights meshing to couple the first and second cantilevered crankshafts for mutual rotation such that rocking and inertial forces of one crankshaft tends to balance rocking and inertial forces of the other crankshaft.

13. The engine of claim 12 wherein the first cylinder includes a bore with a centerline intersecting an axis of rotation of the first crankshaft and the second cylinder includes a bore with a centerline intersecting an axis of rotation of the second crankshaft.

14. The engine of claim 12 wherein the first piston turns a crank in a first plane about a first axis generally perpendicular to a centerline of the bore of the first cylinder and the second piston turns the second crank in a second plane and about a second axis generally perpendicular to a centerline of the bore of the second cylinder; the first and the second planes being substantially parallel to each other and offset, the first and second axes being parallel, and the centerlines of the first and second cylinders are canted toward each other in the respective first and second planes.

15. A uniflow engine comprising:

a first piston mounted for reciprocal, linear movement within a first cylinder;

a second piston mounted for reciprocal, linear movement within a second cylinder;

a common combustion chamber joining the first and second cylinders for allowing flows of exhaust and fresh charge from the first cylinder to the second cylinder;

a first cantilevered crankshaft coupled to the first piston and extending in a first direction; and a second cantilevered crankshaft coupled to the second piston and extending in a second direction opposite the first, the first and the second crankshafts coupled for mutual rotation.

16. The uniflow engine of claim 15 further comprising:

a starter system coupled to the first crankshaft to crank the engine for starting; and a flywheel and engine output shaft coupled to the second crankshaft.

17. The engine of claim 15 wherein each cantilevered crankshaft includes a counterweight integrally formed with a gear, the gears of each crankshaft counterweight meshing to couple the first and second cantilevered crankshafts for mutual rotation.

18. The engine of claim 17 wherein the first cylinder includes a bore with a centerline intersecting an axis of rotation of the first crankshaft and the second cylinder includes a bore with a centerline intersecting an axis of rotation of the second crankshaft.

19. The engine of claim 17 wherein the first and second pistons have asymmetrical timing that is variable by offsetting the relative rotational positions of the geared counterweights.

20. The engine of claim 15 wherein the first and the second cantilevered crankshafts are mounted within a common crankcase.

21. The engine of claim 20 wherein the second cylinder includes an intake port between a carburetor and the crankcase for transferring fresh charge from a carburetor during an upstroke in the second piston, and the first cylinder includes a transfer port between the crankcase and the first cylinder for scavenging the first and second cylinders; the fresh charge flowing across the common crankcase to improve lubrication of the coupling between the first and second crankshafts in the common crankcase.

22. The engine of claim 21 wherein the second cylinder includes an exhaust port to transfer exhaust gases to a muffler.

23. A uniflow engine comprising:

a first piston mounted for reciprocal, linear movement within a first cylinder;

a second piston mounted for reciprocal, linear movement within a second cylinder;

a first crankshaft coupled to said first piston;

a second crankshaft coupled to said second piston, said first and second crankshafts being coupled for mutual rotation and extending in opposite, but parallel directions;

a common combustion chamber joining the first and second cylinders for allowing flows of exhaust and fresh charge from the first cylinder to the second cylinder;

wherein the second cylinder includes an intake port to transfer fresh charge of fuel and air from a carburetor to a crankcase and further includes an exhaust port to expel exhaust gases from the first and second cylinders; and wherein the first cylinder includes a scavenging port for transferring the fresh charge from the crankcase to the first cylinder for scavenging the first and second cylinders.

24. The engine of claim 23 wherein there is a plurality of scavenge ports on the first cylinder arranged to create a charge swirl to improve scavenging of the first and second cylinders.

25. The engine of claim 23 wherein the timing of the first piston is retarded with respect to the timing of the second piston such that opening and closing of the exhaust port occurs before the opening and closing of the of the scavenge port to improve trapping efficiency.

26. The engine of claim 23 wherein each cylinder has a stroke to bore ratio of at least 1.33.

27. A uniflow engine for powering portable work producing equipment comprising:

a first piston mounted for reciprocal, linear movement within a bore of a first cylinder;

a second piston mounted for reciprocal, linear movement within a bore of a second cylinder;

a common combustion chamber joining the first and second cylinders for allowing flows of exhaust and fresh charge from the first cylinder to the second cylinder;

wherein the first and second cylinders are siamesed and skewed with respect to each other, within planes canted toward each other in a first direction and displaced with respect to each other in a second direction perpendicular to the first direction for tending to minimize a distance between the tops of the first and cylinders.

28. A portable work producing apparatus comprising:

a work producing implement supported on a means for mounting;

handles supported on the means for mounting for maneuvering the work producing implement;

a internal combustion engine supported on the means for mounting having an output shaft coupled to the work producing implement to deliver power to the implement, the internal combustion engine comprising:

first and second pistons mounted respectively in first and second cylinders;

first and second crankshafts supported within a crankcase in a cantilevered fashion and driven, respectively, by the first and second pistons; each cantilevered crankshaft having first and second ends and a counterweight mounted on its first end for rotating the crankshaft with the respective piston;

wherein the first and the second cantilevered crankshafts are coupled for counter-rotation and extend in opposite, but parallel directions.

29. The apparatus of claim 28 further comprising:

a starter system coupled to the second end of the first crankshaft; and a flywheel and engine output shaft coupled to the second end of the second crankshaft.

30. The apparatus of claim 28 wherein the counterweights include gear teeth, the counterweights meshing to couple the first and second cantilevered crankshafts for mutual rotation.

31. The apparatus of claim 30 wherein the first cylinder includes a bore with a centerline intersecting an axis of rotation of the first crankshaft and the second cylinder includes a bore with a centerline intersecting an axis of rotation of the second crankshaft.

* * * * *

UNITED STATES PATENT AND TRADEMARK OFFICE

CERTIFICATE OF CORRECTION

PATENT NO. : 5,383,427

DATED : January 24, 1995

INVENTOR(S) : Tuggle et al.

It is certified that error appears in the above-indentified patent and that said Letters Patent is hereby corrected as shown below:

Column 2, line 23, delete "popper" and insert --poppet--; and
line 57, delete "at." and insert --al.--.

Column 4, line 10, delete "cylinders;" and insert --cylinders--.

Column 5, line 50, delete "them" and insert --there--.

Column 7, line 37, delete "ram," and insert --turn,--

Column 9, line 7, after "pin" insert --408--;

line 52, delete "With" and insert --with--.

Column 11, line 9, delete "doses" and insert --closes--.

Column 16, line 1, delete "the"; and
line 2, after "and" insert --second--.

Signed and Sealed this

Twenty-sixth Day of December, 1995

*Attest:*

Bruce Lehman

BRUCE LEHMAN

*Attesting Officer*

*Commissioner of Patents and Trademarks*